United States Patent [19]

Kurohiji et al.

[11] 4,092,942

[45] June 6, 1978

[54] MOBILE SHOT BLASTING APPARATUS FOR SHOT BLASTING THE BOTTOM OF A SHIP OR THE LIKE

[75] Inventors: Sinichi Kurohiji, Tanashi; Genshichi Shigyo, Mitaka; Nobujiro Arai, Yokohama, all of Japan

[73] Assignee: Magster Company, Japan

[21] Appl. No.: 812,524

[22] Filed: Jul. 5, 1977

[51] Int. Cl.[2] ..... B60S 3/02

[52] U.S. Cl. ..... 114/222; 51/417; 51/425; 51/432

[58] Field of Search ..... 114/222; 51/417–419, 51/424, 425, 428–430, 432, 434; 15/95, 96; 180/6.7

[56] References Cited

U.S. PATENT DOCUMENTS

| | | | |
|---|---|---|---|
| 3,716,947 | 2/1973 | Carpenter et al. | 51/417 |
| 3,827,187 | 8/1974 | Yamamoto et al. | 114/222 |
| 3,859,948 | 1/1975 | Romano et al. | 114/222 |

*Primary Examiner*—Trygve M. Blix
*Assistant Examiner*—Stuart M. Goldstein

[57] ABSTRACT

A shot blasting apparatus rotatable about a caterpillar tractor has a rotor, fed recirculated shot via two screw conveyors, which hurls shot at the ships bottom at an angle optimal for collection and sorting of the reflected shot debris and dust. Shock absorbingly supported at the top of the blaster is a casing, magnetically held to the ship, which is slidably supported in a box so as to "float" weightlessly. A bag filter and fan, mounted on the tractor, extract dust and debris from the shot blaster.

19 Claims, 5 Drawing Figures

MOBILE SHOT BLASTING APPARATUS FOR SHOT BLASTING THE BOTTOM OF A SHIP OR THE LIKE

This invention relates to a mobile shot blasting apparatus and more particularly to a tractor type vehicle equipped with a shot blasting apparatus suitable for cleaning the bottom or under side of a ship or the like.

As is well known ships require periodic dry docking for cleaning, repair and general maintenance. This cleaning can be carried out in a number of different types of dry dock, only one of which is a graving dock. However for simplicity only the latter will be described.

A graving dock is usually a land excavation, the sides and bottom of which are lined with concrete. A water tight door is provided. A number of piles are provided therein for supporting the vessel after the water has been pumped out. To assist this pumping operation usually a number of drainage channels are formed in the bottom of the dock. These channels are particularly useful as the level of water in the dock drops to a low level. Thus dry-docking is simply achieved by floating the ship into the dock and closing the water tight door behind it. As the water is pumped out the ship settles onto the vertical piles.

The bottom of a ship is usually fouled by marine growths such as barnacles, mussels and sea grasses, and is usually corroded. Removal of the fouling rust and old paint is necessary before rust proofing painting etc. can begin. Cleaning is, in most cases, best done by shot blasting.

A number of problems arise when shot blasting the bottom of a ship. These include the limited clearance between the bottom of the ship and the bottom of the dry dock, limited space between the piles in which to maneuver, and the frequent drainage channels and protrusions abound in and on the bottom of a dry dock. Therefore maneuvering a shot blasting machine in such a confined space is very difficult. Yet another problem is that shot blasting generates a great deal of dust which is detrimental to the health if inhaled. Thus, previously nobody could work in the vicinity of the shot blaster due to the hazardous nature of the dust.

Attempts have been made to overcome these problems by employing apparatus suited to shot blasting vertically downwards or horizontally, by attaching such devices to cranes tractors and the like. These arrangements have met with some success but are far from satisfactory. One major problem is that the shot must be fired vertically upwards toward the ships hull. The prior art has suffered from the lack of ability to constantly supply the blaster with recirculated shot in this position. Additionally, when the blaster is moved, especially when mounted on a tractor type vehicle a large amount of dust is released. The reason for this release is, as the vehicle encounters any one of the many obstacles, such as piles, channels and the like, it jolts. The jolt is often severe enough to cause the blasting mouth of the blaster, which is usually held sealingly in place by magnetic force, to lose contact with the surface of the ships hull. Thus large quantities of dust and debris are released into the air.

Therefore it is an object of this invention to provide a mobile shot blasting apparatus which overcomes the above mentioned shortcomings.

It is also an object of this invention to provide a mobile shot blasting apparatus which is compact and capable of efficiently maneuvering in the limited confines below a ship in dry dock.

It is still another object of this invention to provide a mobile shot blasting apparatus which can maintain a dust tight seal between the mouth of the blaster and the ship despite jolting of the associated tractor by obstacles in and on the bottom of the dock as it traverses same.

It is yet another object of the invention to provide a mobile shot blasting apparatus which continuously supplies the blasting device with recirculated shot and simultaneously separates the debris from same, prior recirculation.

According to the present invention, there is provided a mobile shot blasting apparatus for shot blasting the bottom of a ship or the like comprising: a shot blasting mouth shock absorbingly mounted atop a shot blasting apparatus which is supported by a self-contained vehicle, which is characterized by the ability to traverse the bottom of a dry dock, wherein there are ship supporting piles, drainage channels and protrusions, and maintain a dust-tight seal between the shot blasting apparatus and the bottom of the ship or the surface to be cleaned during shot blasting despite jolting of the vehicle.

A detailed description of the invention will now be given in conjunction with the accompanying drawings in which.

Figure 1:
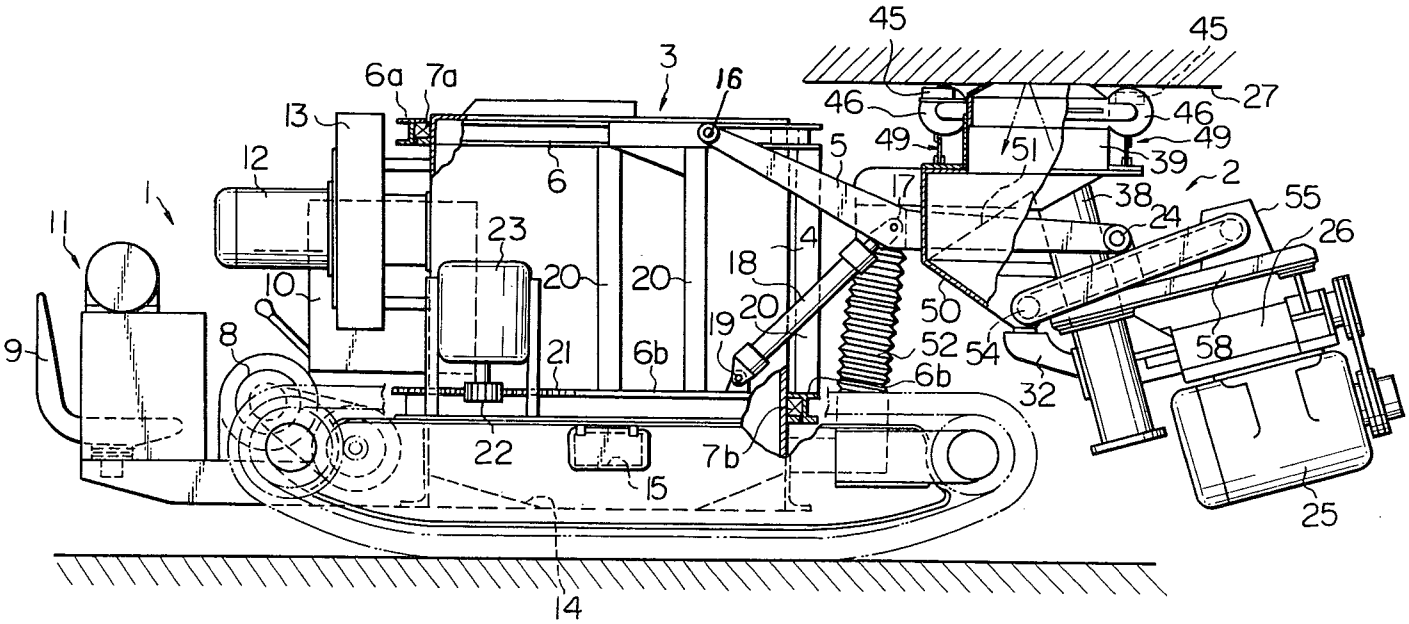
FIG. 1 is an elevational view of a preferred embodiment of the invention (partly in section) showing a tractor equipped with a shot blasting apparatus at the front thereof.
Figure 2:
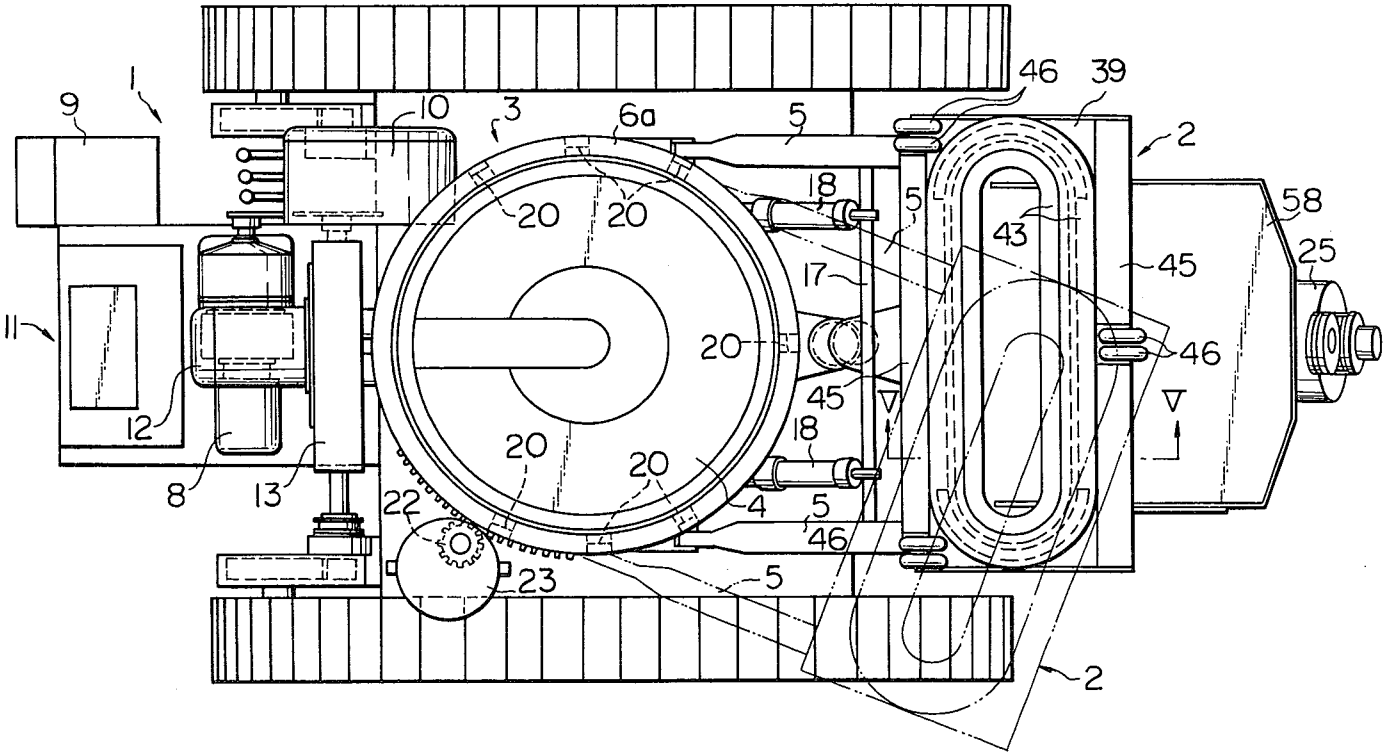
FIG. 2 is a plan view of the vehicle shown in FIG. 1.

In FIGS. 1 and 2 there is shown a caterpillar type tractor, generally indicated by the numeral 1. At the front of the tractor, a shot blasting apparatus, generally indicated by the numeral 2, is mounted. Mounted in the middle of the tractor is a circular bag filter 3. The bag filter 3 is disposed within a bag filter casing 4. The bag filter casing 4 is firmly attached to the top of the tractor body (no numeral). Two bearings *7a* and *7b* are disposed about the uppermost and bottommost perifery of the bag filter casing 4 respectively. Two ring members *6a* and *6b* are rotatably supported on the two bearings *7a* and *7b* respectively. A plurality of rod or beams 20 are fixed to the ring members *6a* and *6b*. These rod 20 serve to provide structural strength to, and are rotatable with, the two ring members. The whole assembly is therefore rotatable about the bag filter case 4.

Two supporting arms 5 are pivotably mounted through pins 16 to the upper ring *6a*. At the other ends of the arms 5, mounted pivotably through pins 24 is the shot blasting apparatus 2.

In FIGS. 1 and 2, two hydraulic cylinders 18 are shown pivotably attached to the lower ring member *6b* via a lug (no numeral) through pins 19. The other ends of the cylinders 18 are pivotably connected to the supporting arm 5 through pins 17.

Although two cylinders are shown and described it is preferably to have only one, for the following reasons. It is difficult to supply exactly the same volume of oil at exactly the same pressure to each cylinder simultaneously. Furthermore the compressibility of the oil is not constant, to add to the problem. Resultingly one cylinder is apt to expand or contract faster or slower than the other, and vice versa. This causes the supporting arms to shudder undesirably. The simple provision of only one cylinder overcomes this problem.

Shown at the rear of the tractor body (no numeral) is the drivers seat 9 and control pane 10. Beside the drivers seat is a self contained source of electricity and/or oil under pressure 11. Located just foreward of the afore mentioned unit 11 is a motor and a gearbox, generally indicated by the numeral 8. The motor and gear box may be of any type, e.g. the motor may be electrical hydraulic, or mechanically connected to the unit 11.

Since tractor controls are well known no further explanation will be given.

A fan 13 and a fan motor 12 are attached to the bag filter casing 4 in a suitable manner. The fan 13 fluidly communicates with the bag filter 3 to induct dust and debris laden air from the shot blasting apparatus via the tractor body. The air is inducted through the tractor body where the heavier material precipitates into a collecting pan 14 provided therein. The remaining dust is filtered out by the bag filter 3, and clean air is discharged, via the fan 13 into the atmosphere.

A door or lid (no numeral) is fitted over an opening 15 provided in the side of the tractor body. The dust and debris are removed through this opening after the cleaning operation.

A plurality of gear teeth 21 are provided on the lower ring member **6*b*. Meshing with the gear teeth 21 is a pinion 22 of a motor 23. The motor is suitably mounted on either the bag filter casing 4 or on the tractor body, and operable to rotate the assembly of ring members 6*a*, 6*b* and rods 20. Therefore the motor 23 serves to rotate the shot blaster via the support arms 5 and the hydraulic cylinders 18**.

Figure 4:
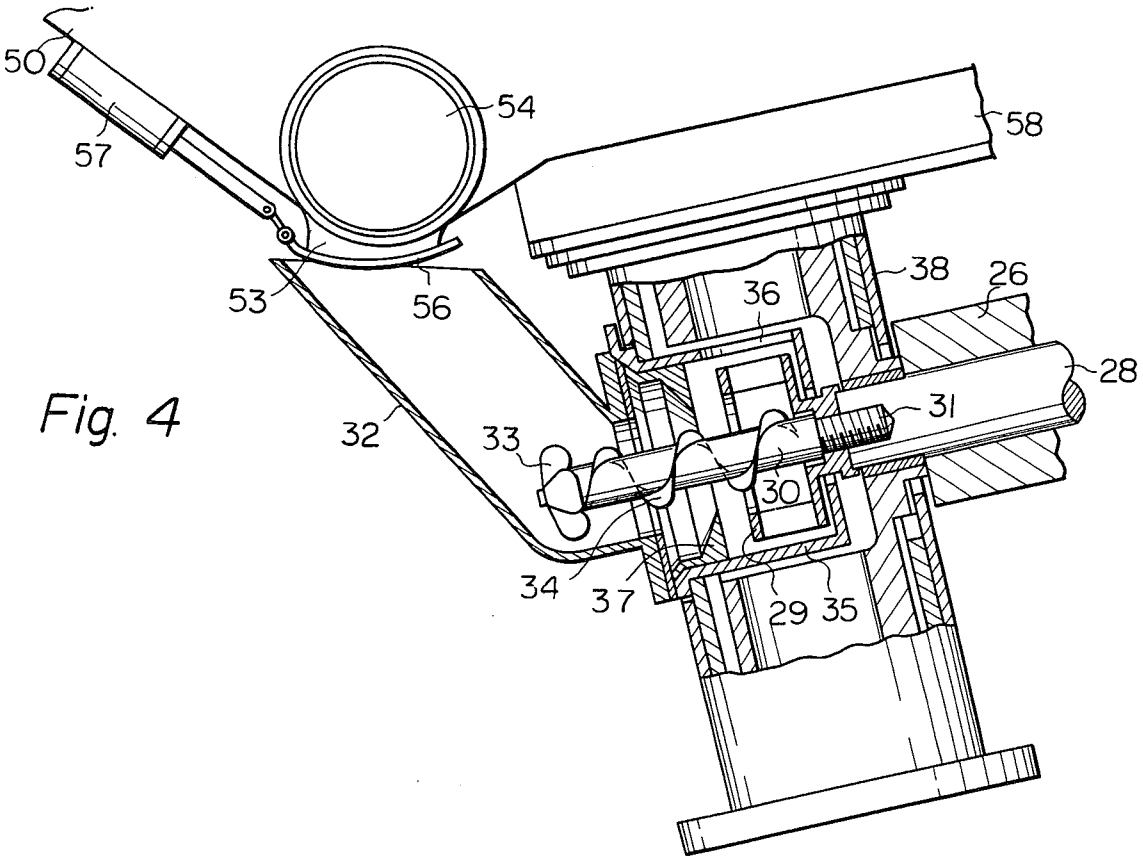
FIG. 4 is a partially sectioned view of the lower portion of the shot blasting apparatus.

Reference will now be made to FIGS. 1 and 4 wherein, generally designated by the reference numeral 2 is the shot blasting apparatus. As previously described the shot blasting apparatus is pivotably mounted via pins 24 on the support arms 5. A motor 25 is disposed at the lowermost portion of the shot blasting apparatus 2, and is connected via a vee belt and pulley arrangement (no numeral) to a shaft 28 rotatably disposed in a housing 26. As best seen in FIG. 4, connected at the end of the housing 26 is a casing or shot blasting barrel 38. Disposed within the barrel 38 is a rotor 29 rotatably housed in a rotor housing or deflector 35 arranged to pass through the centre of the rotor is a screw conveyor 30. Formed on its surface is a helical thread 34. One end of the screw conveyor 30 is secured to the shaft 28 via a thread 31. The thread 31 also fastens the rotor 29 to the end of the shaft 28. As shown the screw conveyor 30 the rotor 29 and the shaft 28 are co-aligned and unitedly rotatable. The other end of the screw conveyor projects through a one way feed member 37 secured in an opening (no numeral) formed in the barrel 38. This one way feed member is preferably made of resin or suitable resilient material. An impeller 33 is fixed to the end of the screw conveyor 30 so as to be exposed to the interior of a supply chute 32. The chute 32 communicates with the interior of the rotor 29 and rotor housing 35 via the one way feed member 37, the impeller 33 and the screw conveyor 30. A hole or orifice 36 is provided in the rotor housing 35 and oriented so that the high velocity shot is directed upwardly through the barrel 38 to impinge on a surface to be cleaned 27.

A shot and debris collecting hopper 50 (shown partially in cut away section in FIG. 1) is disposed between the support arms 5 and about the upper portion of the barrel 38. A screw conveyor 54 similar to the screw conveyor 30 is located at the bottom apex of the hopper 50 which is rotatable to urge the shot collected therein through an opening 53 is formed in the hopper just below one end of the screw conveyor 54. A gate member 56 is provided to open and close the opening 53 to permit or prevent the passage of shot therethrough. The gate is operated by a hydraulic cylinder or motor 57 secured to the side of the hopper 50.

A flexible duct 52 connects the interior of the hopper 50 and the interior of the tractor body, as best seen in FIG. 1 so that dust and debris are inducted away from the shot blasting apparatus via same.

A screen 51 is disposed in the hopper between the opening 53 and the mouth of the flexible duct so as to guide the dust and the debris into the duct and separate the shot and guide same toward the opening 53. A motor 55 is operatively connected to the screw conveyor 54 via a chain drive arrangement (no numeral). The motor 55 is mounted on a supporting frame 58 (which) is connected to the support arms 5 via pins 24 as previously described. The barrel 38 is also connected to the supporting frame 58 as seen in FIG. 4.

Figure 3:
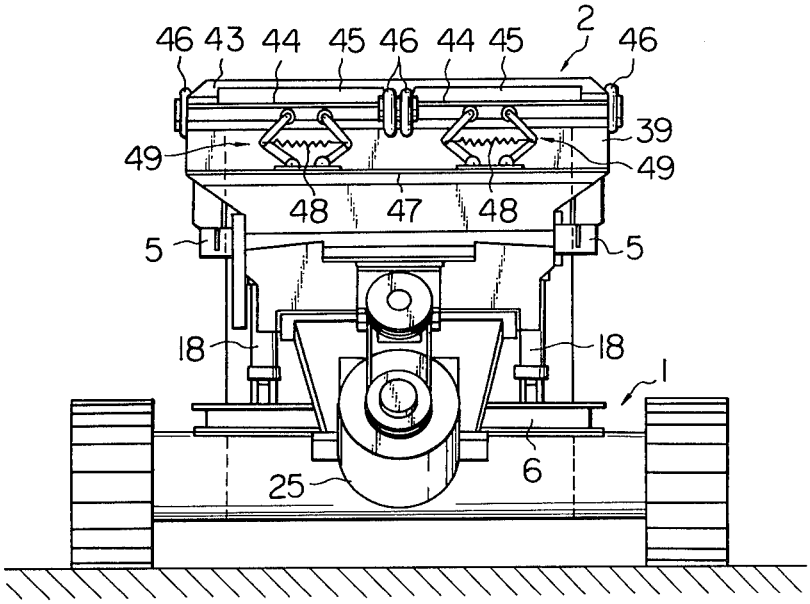
FIG. 3 is a front elevational view of the vehicle shown in FIG. 1.
Figure 5:
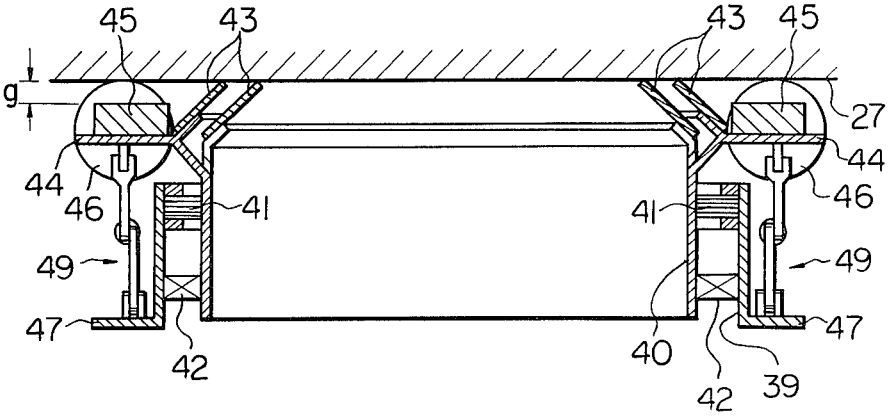
FIG. 5 is a sectional view of the upper portion of the shot blasting apparatus as viewed from the side of the vehicle.

Reference is now made to FIGS. 3 and 5 wherein a box member 39 is shown fastened to the top of the hopper 50 and the barrel 38. Both the hopper 50 and the barrel 38 communicate with the interior of the box member 39 so that the high velocity shot may pass from the barrel, through the box member, strike or impinge on the surface to be cleaned, deflect, and be collected in the hopper 50. A casing 40 is slidably disposed in the box member 39. A plurality of urging means 49, in this case toggle type urging means, are pivotably mounted on flanges 47 protruding from the box member 39. The toggle members 49 act on flanges 44 protruding from the casing member 40 via rollers (no numeral) rotatably disposed at the tops of the toggle members. The function of these toggle members will be described later. However any other suitable type of urging means may be used in place of the afore mentioned toggle members. The casing 40 is also provided with through holes in the top and bottom surfaces thereof for permitting the shot to freely pass through the casing impinge on the surface to be cleaned, reflect, and be collected by the hopper. A plurality of stoppers 42 are provided on the casing 40. These have a dual function, one is guide the casing as it slides (vertically) in the box member 39, the other is to limit the vertical travel of the casing. A seal 41 is fixed to the top edge of the box member and arranged to about the casing 40. A number of rubber plates (or similar elastomer) are arranged between the two parallel flanges (no numeral) to sealingly abut the outer perifery of the casing 40. Thus the casing may slide vertically through the box member until the stoppers 42 engage the seal 41, at which time further travel is prevented. It is preferred according to this invention that the distance travelable by the casing 40 in the box member 39 is about 100 mm, although this value is variable. Mounted on the top of the flanges 44 are a plurality of magnets. These may be permanent or electromagnetic or a mixture of both. Attached to smaller branch flanges (no numeral) are two flexible grommet like seals 43 which are made from rubber or any other suitable material. The seals are shown in FIG. 5 dust tightly contacting the surface 27. The adjacent magnets 45 function to urge the casing and the seals 43 into contact with the surface to be cleaned. Rotatably mounted on the flanges 44 are, preferably, three rollers (or three sets of rollers); the reason for this preference will be made clear later. The rollers serve to prevent the magnets, which are attracted to the surface to be cleaned, from touching same. The size of the rollers is so selected so as to provided a gap "g" between the surface to be cleaned and the upper surface of the magnets 45. The magnitude of this gap is about 6 mm.

As best seen in FIG. 2 the seals 43 extend completely around the mouth of the through hole formed in the upper surface of the casing 40. Thus the entire perifery of blasting mouth, as it will referred to from this point on, is dust tightly sealed against the surface to be cleaned.

The operation of the invention will now be described. The hydraulic cylinders 18 are activated to raise the shot blasting apparatus up against the surface to be cleaned 27 (ship bottom). Once the magnets 45 are sufficiently close to the surface they alone lift the casing up into contact with the surface 27 (or induce it to slide vertically). The reason that the magnets alone move the casing is the toggle members 49 are equipped with springs 48 which are so selected to just compensate for the weight of the casing 40. The casing therefore "floats" in the box member to be easily urged up or down. Hence the power of the magnets 45 is alone sufficient to move and maintain the casing in contact with the surface 27. It is undesirable that the magnets 45 actually touch the surface 27 but preferably to maintain them as close as possible to same. The reason for this is the blasting mount would become extremely difficult to move along the surface 27 under the latter conditions.

Once the blasting mouth is suitably placed against the surface the motor 25 is started. The gate 56 is opened and the motor 55 started. Shot is fed down the chute 32 by the rotation of the screw conveyor 54. As the shot contacts the impeller 33 it is smashed to a suitable size, and then urged by the screw conveyor 30 through the one way feed member 37 into the rotor 39. The rotor rotating at a high RPM hurls the shot (via centrifugal force) out through the opening 36 and up against the surface 27. As will be noticed the barrel 38 and the hole 36 formed in the rotor housing 35 are arranged so that the trajectory of the shot forms a predetermined angle with the plane defined by the very tops of the rollers 46. This obtuse angle is selected to produce an angle of incidence with the surface of about 20°. The angle of reflection is therefore about 20°. This approximate 40° angle (total) provides excellent conditions for collecting and separating the shot from the dust and debris. As the shot dust and debris strikes the screen the lighter less dense dust and debris move into the flexible duct while the heavier dense shot passes through the screen to be recirculated via the screw converter 54 as previously described. Even if some of the debris finds its way into the rotor it can be utilised as shot and/or will be powdered and extracted by the fan 13.

Once the shot blasting apparatus is operating the tractor is started to traverse the bottom of the dry dock at a speed of about 1 meter per min.

Stopping the blasting operation is simple and is as follows. The tractor is halted, the motor 55 is stopped and the gate 56 is closed. Thus the feed of shot to the rotor is stopped. The motor 25 is stopped and the blasting mouth is lowered to break the seal between it and the surface 27.

During operation it would be thought preferable to be able to rotate the shot blasting apparatus 360° about the tractor, however in actual practice it has been found impractical to rotate the apparatus more than about 40° due the severe crowding of the piles that support the ship, drainage channels and protrusions etc.

The features and advantages of the invention just described will now be highlighted. One of the drawbacks suffered by the prior art is the frequent loss of dust tight sealing between the shot blasting apparatus and the bottom of the ship. This defect has been eliminated in this invention by the provision of the "floating" casing 40. The casing is held in place by the magnets 45, and when the tractor strikes a protrusion, turns, or traverses a channel it jolts or otherwise moves in a manner to in turn jolt the shot blasting apparatus. In the prior art this is sufficient to break the seal between the blasting mouth and the bottom of the ship. However it is a feature of this invention that the casing 40 floats, shock absorbingly in the box member 39 to maintain an excellent dust tight seal between the blasting mouth and the surface 27. Hence as the tractor is travelling at a very low speed (one meter per min.) the driver or operator has adequate time to take any necessary steps should a major obstacle present itself.

A further feature of this invention is found in the provision of three rollers 46. These rollers are arranged at substantially the three apexes of a triangle. This provision enables the shot blasting apparatus 2 to be turned and maneuvered while in contact with the ships bottom far more easily than a four wheel system arranged at the corners of a rectangle or square.

Another feature of this invention is found when cleaning a non-uniform surface. A surface having minor protrusion and depressions have posed a problem for the prior art but as the blasting mouth of the invention traverses such a location the seals 43 flex upwardly to compensate for the non-uniformity. During normal, problem free, blasting the seals 43 also flex upwardly to compensate for the change in distance between the blasting mouth and the surface being blasted (due to the layer of barnacles etc. being worn down by the impingement of the high velocity shot).

It will be appreciated that major obstacles such a as stabilizer fins keels etc. require the operators attention, however the invention can as described overcome any minor variation without difficulty. Variation in the surface, especially where the hull or surface curves upwardly, can be easily followed by the shot blasting apparatus disclosed hereinbefore since it is pivotably supported about pins 24. The weight distribution, also, is such that the shot blasting apparatus is statically balanced about said pins. Hence as the surface 27 curves the driver can orient the shot blasting apparatus so that it pivots and appropriately follows the curvature. Moreover the shot blasting apparatus is rotatable about the tractor (approximately 40°) so that previously tight corners and problem areas become readily accessible. Furthermore a positive and constant supply of shot will be fed to the rotor despite any variations in inclination, due to the provision of the two screw conveyors 54 and 30, thus eliminating yet another drawback suffered by the prior art.

The combination of the tractor and the shot blasting apparatus described is compact, adding to it high maneuverability in confined spaces; being approximately 1.2 meters high and totally 5.3 meters long.

It will be appreciated that it is a combination of functions or features that characterize this invention rather than a combination of specific apparatus, so that many variations are possible without departing from the spirit and scope of the invention.

What is claimed is:

1. In a mobile shot blasting apparatus for the bottom surface of a ship;

a tractor;

dust collecting means disposed in the tractor;

support means operatively mounted on the tractor having an arm which is vertically pivotably and horizontally rotatable about the tractor;

shot blasting means pivotably mounted on the end of the arm and fluidly connected to the dust collecting means for transfer of dust and debris from the shot blasting means;

shot accelerating means operatively disposed in the shot blasting means for directing shot at a predetermined angle;

a hopper disposed in the shot blasting means and arranged to collect the shot and debris reflected and disloged from the surface;

separating means arranged in the hopper to separate the shot from the dust and debris and direct the dust and debris to the dust collecting means and the shot to the bottom of the hopper;

a first conveyor means disposed at the bottom of the hopper to convey the shot collected therein through an opening, closably by gate means, formed in the bottom of the hopper into a supply chute;

a second conveyor means operatively connected to the shot accelerating means, which communicates with the supply chute to convey shot therein into the shot accelerating means;

the improvement comprising:

box means disposed in the upper portion of the shot blasting means and provided with through holes in the upper and lower surfaces thereof to permit therethrough the passage of high velocity shot from the shot accelerating means;

casing means slidably disposed in the box means which has through holes formed in the upper and lower surfaces thereof to permit therethrough the passage of high velocity shot from the shot accelerating means;

urging means operatively connected to the box means and the casing means to urge the casing means upwardly against the weight of the casing means so that the casing means is slidable in the box means via the application of a small force;

magnetic means disposed on the upper portion of the casing means to attract and hold the casing means against the surface to be shot blasted and;

roller means mounted on the upper portion of the casing means to contact the surface and maintain a predetermined gap between the upper surface of the magnetic means and the surface to be shot blasted.

2. A mobile blasting apparatus as claimed in claim 1 further comprising first sealing means disposed on the upper portion of the casing means about the through hole to dust tightly seal the casing means against the surface to be shot blasted and second sealing means disposed between the box means and the casing means to prevent the passage of dust and debris between the outer periphery of the casing means and the inner periphery of the box means but permit the casing to slide within the box means.

3. A mobile shot blasting apparatus as claimed in claim 1 in which said dust collecting means comprises a bag filter disposed in a bag filter casing, a fan, equipped with a motor to drive same, operatively mounted on the bag filter casing to fluidly communicate with the bag filter to induct a flow of air therethrough, a collecting pan disposed in the tractor below the bag filter to permit thereinto the precipitation of dust and debris carried in the air flow;

a flexible dust fluidly connecting the shot blasting means to the bag filter via the collecting pan to permit the flow of air inducted by the fan to carry dust and debris from the shot blasting means to the bag filter via the flexible duct and collecting pan.

4. A mobile shot blasting apparatus as claimed in claim 1 wherein said shot accelerating means disposed in said shot blasting means comprises a rotor rotatably housed in a rotor housing for high speed rotation therein the rotor housing having a through hole formed therein which is so oriented to direct the shot hurled from the rotor during high speed rotation upwardly at a predetermined angle.

5. A mobile shot blasting apparatus as claimed in claim 1 wherein said separating means comprises a screen disposed in the hopper which is arranged to separate shot dust and debris impinging thereon and direct the less dense dust and debris into the flexible dust and the more dense shot to the bottom of the hooper.

6. A mobile blasting apparatus as claimed in claim 1 wherein said first conveyor means comprises a screw conveyor which is rotatable to conveyingly urge the shot in the lower portion of the hooper to and through a hole formed in the hopper, the hole being formed just below one end of the screw conveyor, that one being the end to which the shot is urged by the rotation of the screw conveyor.

7. A mobile shot blasting apparatus as claimed in claim 1 wherein said second conveying means comprises a screw conveyor one end of which extends into a supply chute shot supplyingly connected to the said through hole formed in the hopper, to conveyingly urge shot supplied thereinto by the first conveyor means, to the rotor housed in the rotor for high speed discharge therefrom.

8. A mobile shot blasting apparatus as claimed in claim 1 wherein said box means further comprises:

a first flange projecting outwardly from the lower peripheral portion of the box means; and parallel second and third flanges projecting inwardly about the entire inner upper peripheral portion of the through hole formed in the upper surface of the box means.

9. A mobile shot blasting apparatus as claimed in claim 1 wherein said casing means further comprises:

a fourth flange projecting outwardly from the upper outer peripheral portion of the casing means;

parallel fifth and sixth flanges projecting obliquely inwardly and upwardly from the upper inner peripheral portion of the through hole formed in upper surface of the casing means and a plurality of stoppers formed on the outer periphery of the casing means which are arranged to project outwardly so as to slidingly abut the inner periphery of the box means and to limit the upward travel of the casing means within the box means upon abutment with the second and third flanges.

10. A shot blasting apparatus as claimed in claim 9 wherein said first sealing means comprises a grommet shaped seal made of an elastomeric material fixedly attached to each of said fifth and sixth flanges so as to project obliquely upwardly and inwardly to dust tightly contact the surface to be shot blasted during shot blasting.

11. A shot blasting apparatus as claimed in claim 9 wherein said second sealing means comprises a plurality of elastomeric material plates disposed parallely between said parallel second and third flanges and arranged to sealingly abut the outer periphery of the casing means but permit the casing means to slidably pass therethrough.

12. A mobile shot blasting apparatus as claimed in claim 1 wherein said roller means comprises three rollers disposed on the upper surface of the casing means each roller being arranged at each apex of a triangle with each axis of rotation parallel the parallel axes being perpendicular to the said arm of the said support means.

13. A mobile shot blasting apparatus as claimed in claim 1 wherein said predetermined angle is an angle defined between the plane defined by the three uppermost points of the three rollers and the trajectory of the shot such that the angle of incidence of the shot with the surface to be cleaned is between 5° and 85°.

14. A mobile shot blasting apparatus as claimed in claim 1 wherein said magnetic means is at least one electromagnet.

15. A mobile shot blasting apparatus as claimed in claim 1 wherein said magnetic means is at least one permanent magnet.

16. A mobile shot blasting apparatus as claimed in claim 1 wherein said tractor is equipped with caterpillar tracks.

17. A mobile shot blasting apparatus as claimed in claim 1 wherein said support means is horizontally rotatable about the tractor at least 40°.

18. A mobile shot blasting apparatus as claimed in claim 1 wherein said urging means is at least one spring loaded toggle member operatively disposed between the said first flange and said fourth flange of the box means and the casing means respectively.

19. A mobile shot blasting apparatus as claimed in claim 9 wherein said upward travel is at least 100 mm.

* * * * *